United States Patent [19]

Wihksne

[11] 4,004,691

[45] Jan. 25, 1977

[54] GLOVE PACKAGE BOX WITH INTERCHANGEABLE IDENTIFICATION

[75] Inventor: Allen Wihksne, Fort Worth, Tex.

[73] Assignee: Arbrook, Inc., Arlington, Tex.

[22] Filed: Dec. 22, 1975

[21] Appl. No.: 643,442

[52] U.S. Cl. ..... 206/459; 40/312; 206/45.31; 229/17 B; 229/37 R

[51] Int. Cl.[2] ..... B65D 5/72; B65D 83/00

[58] Field of Search ..... 206/459, 44.11, 44.12, 206/45.31, 534, 232, 491; 40/312, 109, 107; 229/37, 38, 73, 6 R, 17 B

[56] References Cited

UNITED STATES PATENTS

| | | | |
|---|---|---|---|
| 1,429,096 | 9/1922 | Pethick | 40/109 |
| 1,986,101 | 1/1935 | Brodsky | 229/17 B |
| 3,205,603 | 9/1965 | Brumley | 229/6 R |

*Primary Examiner*—William T. Dixson, Jr.
*Attorney, Agent, or Firm*—John Simkanich

[57] ABSTRACT

A box for holding and enclosing a plurality of fixed size and character packages, from amongst a plurality of predetermined character packages, is provided having preferably six sides, each rectangularly shaped and positioned to define a rectangular enclosure. A bottom end may be provided to close one end of this rectangular enclosure while an identification end may be provided to close the other end. Included as part of this identification end may be a plurality of symbols, one each identifying one among the plurality of predetermined character packages as contained in the box. The symbol representing the contents may be selectively displayed via a removable display window located on an outer panel comprising this identification end. Identification symbols may be located on panels folded under the outer panel. As additional symbols are needed they are supplied on additional under-folded panels. The order in which these under panels are folded determines which one will be to the outside and which group of symbols may be available for display.

7 Claims, 4 Drawing Figures

GLOVE PACKAGE BOX WITH INTERCHANGEABLE IDENTIFICATION

BACKGROUND OF THE INVENTION

The indentification of materials when enclosed within a box or carton, without disturbing that box or carton, has been an inventory and manufacturing problem for some time. It has been an inventory problem because it is necessary to identify the goods by size, type or quantity without opening the box or carton. It has been a manufacturing problem because it is desirable to devise a box or carton which readily provides such external identification.

The most common solution to the identification of such material has been the addition of some sort of a marking or indicia on the outside of the box or carton indicative of the contents. Very often this takes the form of a label containing the size, type or quantity of the goods inside. When the same carton is to hold one of a plurality of predetermined sizes, types or quantities it is desirable to incorporate into the box or carton a mechanism by which the correct identification may be registered.

Cornell, U.S. Pat. No. 938,981, teaches the incorporation of an identification window in an end panel of his box for showing an identification label applied to a tuck flap of a box major side panel and inserted behind the window.

Ford, U.S. Pat. No. 2,054,596, teaches a box having a tear away and foldover strip in one end of the dust flap for covering an identification block in a major side panel with a blank side. A new identification number may then be written to cover the original one.

Claff, U.S. Pat. No. 2,644,632, teaches an identification window incorporated into the end panel of his box. This end panel cooperates with the dust flaps on the box to form a pocket behind the identification window for receiving a separate identification tag insertable into the pocket for viewing through the window.

Eisman et al., U.S. Pat. No. 3,071,882, teach a carton having a plurality of selectable punch-out windows in a major side panel. Each window has a pair of identification tags provided by an inner glued flap which may be selectively positioned in the window. A tag not to be viewed is folded away from the window and over the viewed tag. Tags pivot from the edge of each window and may be changed by manipulating from the outside.

Brumly, U.S. Pat. No. 3,205,603, teaches a carton having selectively removable window portions located at one end thereof to reveal strategically placed indicia on other flaps therebeneath. Brumly has located most of his indicia on his dust flaps, but needs additional space on the tuck flap of his major end panel for all of his preselected indicia. As a result, Brumly must locate his removable window portions in a major side panel of his carton as well as in the major end panel.

Cartons which provide identification blocks, windows or other such means on side major panels present the disadvantage that such identification means is not readily accessible when the cartons are stacked.

Cartons which provide identification pockets or windows into which tags or labels are tucked present the disadvantage of at least one additional step in the manufacturing process requiring the handling of a plurality of separate tags or labels apart from the blank forming the carton itself.

Cartons which provide identification windows on more than just a single end panel present the disadvantage of a variable location for such identification which necessitates a search for the identification.

An objective of this invention is to provide all of the possibly needed identification symbols as preprinted parts of the carton blank.

A second objective of this invention is to provide a carton having selectively removable identification window portions for disclosing one of the identification symbols wherein these windows are located only in an end panel of the carton.

A third objective is to provide more than one single identification symbol available for viewing through a single removable window portion.

A fourth objective is to provide predetermined accesses to the carton contents via the identification end panel.

SUMMARY OF THE INVENTION

The objectives of this invention are achieved in a box for holding and enclosing a plurality of fixed size and character packages, this box having four major sides, each rectangularly shaped and positioned to abut one another to form a rectangular six-sided enclosure when combined with a bottom end closure having panels as commonly incorporated for use in packaging and combined with another end closure which may incorporate content identification apparatus.

Included as part of this identification end closure apparatus may be a pair of opposed dust flaps, each being formed as an extension of one of two opposing major sides of the package and being foldable towards one another. Located at preselected positions on the outer surface of each dust flap may be a plurality of different identification symbols being a portion of the total symbols needed, each representing a different one of that portion of the possible characters packages which can be held by the box.

A pair of major end panels may also be included as part of this identification end, these being formed as extensions of the other pair of opposing major sides and being foldable to overlap one another. Preferably, the inner major end panel has on its outer surface, at preselected positions, a plurality of different identification symbols, each representing a different one of the remainder of the possible contents for the box not covered by the two dust flaps. The outer major end panel may have situated in it, at preselected positions corresponding to the positions of the symbols on the dust flaps and the major inner panel, a plurality of window tear tabs. A symbol may be selectively displayed by removing one of these tear tabs.

A perforation line may extend across one of the four major sides to facilitate access into the interior of the box when it is used standing on end.

Access to the contents of the package when it is used laying on its side is facilitated by a perforation line across the outer identification major panel. This perforation line defines a section of this panel which may be broken away providing an opening to the interior of the box, the inner major end panel and the pair of dust flaps being shaped not to project into this opening.

The box may be assembled by folding the four major sides and the bottom panels upon one another, forming the basic box. The dust flaps and inner major end panel, at the identification end, may be folded upon one another in the proper sequence to position the desired contents symbol on the outside to render it available for display. Folding the dust flaps over the inner major end panel excludes this panel's symbols from possible display. Likewise, folding the inner major end panel over the dust flaps excludes these flap symbols from possible display. The outer major panel may then be folded over to mask all exposed identification symbols. A desired display window may be created by removing one of the tear tabs to display the desired symbol.

DESCRIPTION OF THE DRAWINGS

The novel features of this invention, as well as the invention itself, both as to its organization and method of operation, will best be understood from the following description taken in connection with the accompanying drawings in which like characters refer to like parts and in which:

FIG. 3 shows the blank to be folded from which the box is constructed wherein the side opposite the identification end is intended for "glued end" construction.

DETAILED DESCRIPTION OF THE INVENTION

Figure 1:
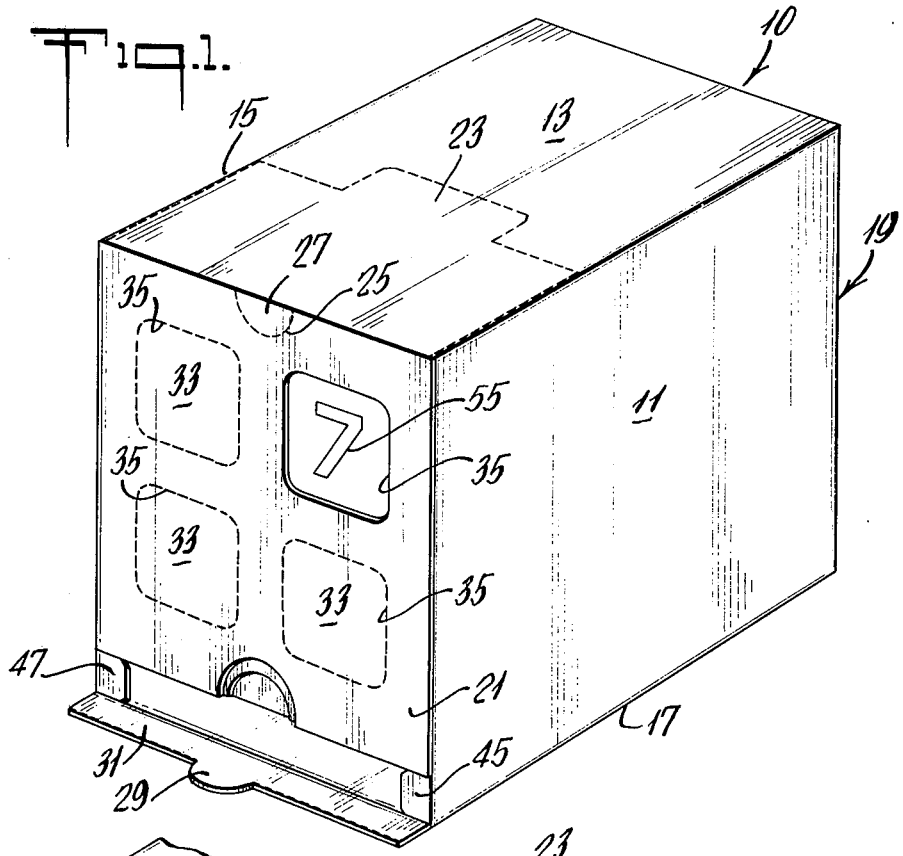
FIG. 1 is a perspective view of the assembled box showing the identification end.

A box for holding and enclosing a plurality of medical glove packages has built-in identification markings. The packaged gloves held in the box are all of the same size from amongst a number of possible sizes, such as eight possible different sizes. The glove size identification is available to the outside of the box. The box 10, FIG. 1 has six walls, these being four side walls 11, 13, 15, 17, a bottom wall 19, and top wall 21. The four side walls 11, 13, 15, 17 are each rectangularly shaped and connectedly closed upon one another, at right angles to form a rectangular enclosure or tube. Two opposing of these side walls form the top side 13 and bottom side 17, respectively, of the rectangular enclosure. The other two opposing side walls form the right side 11 and left side 15, respectively, of the enclosure. Top 13 and bottom 17 sides are each 6.5 inches wide by 10.75 inches long. Left 15 and right 11 sides are each 7 inches wide by 10⅝ inches long.

A perforation line 23 extends across the top side 13 at about a third of the way down its length. This line 23 includes two straight sections extending inwardly from the outer edges of the side 13 and an offset section connecting the two straight sections in the middle of the side. This offset section departs from the straight line projection of the rest of the perforation line 23 to provide a pressure area for opening the box along the perforation line 23.

The bottom wall 19 of the box 10 can be a glued flap style or an "auto-lock" style bottom commonly used in the industry close a bottom end of a rectangular tube. This bottom wall 19 is sized 6.5 inches wide by 7 inches high and comprises two opposed short panel portions and two opposed long panel portions which are formed as extensions of the four sides 11, 13, 15, 17 and glued or folded upon one another as the case may be. The construction of this bottom wall 19 will be readily understood from the discussion to follow of the blank from which the box 10 is constructed.

The top wall 21 of the box 10 closes the remaining open end of the rectangular tube. This top wall 21 becomes the front of the box when the box is stored on a side 17, i.e., stored lying down, and can be referred to hereafter as the identification wall 21.

A perforation line 29 extends across the identification wall 21 parallel to, and at a distance of about one inch from, the fold line of the box 10 between the bottom side wall 17 and the identification wall 21. This perforation line includes two straight sections of equal length joined together by a semicircular section having its excursion away from the side 17 fold line. This latter perforation 29 line defines an access flap 31 which may be broken away from the identification wall 21 and folded over to permit access to the contained packages.

Situated in the identification wall 21, and spaced evenly about the quadrants of the area of this wall 21 which exists above the access flap perforation line 29, are four possible display windows 33. These display windows 33 are each defined by a tear tab established essentially by rectangular perforation line 35. A desired window, such as the upper right quadrant window 33, FIG. 1, may be punched out or otherwise torn away to expose a symbol concealed behind it.

Figure 2:
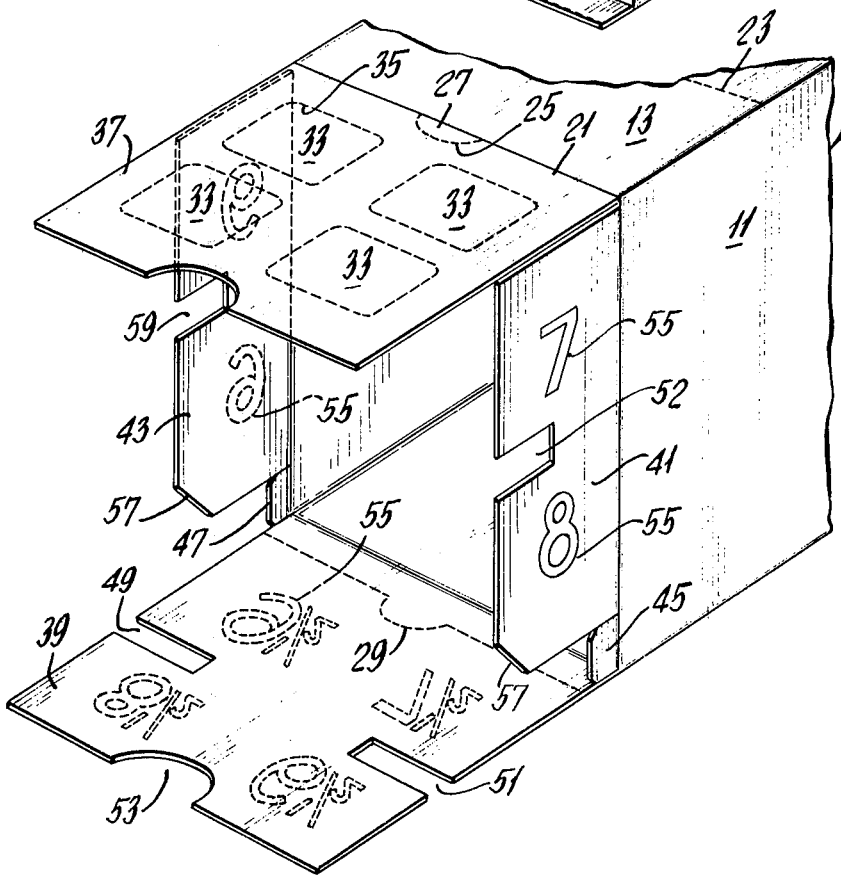
FIG. 2 is a perspective view of the identification end of the box of FIG. 1 showing the unfolded flaps and end panels.
Figure 2:
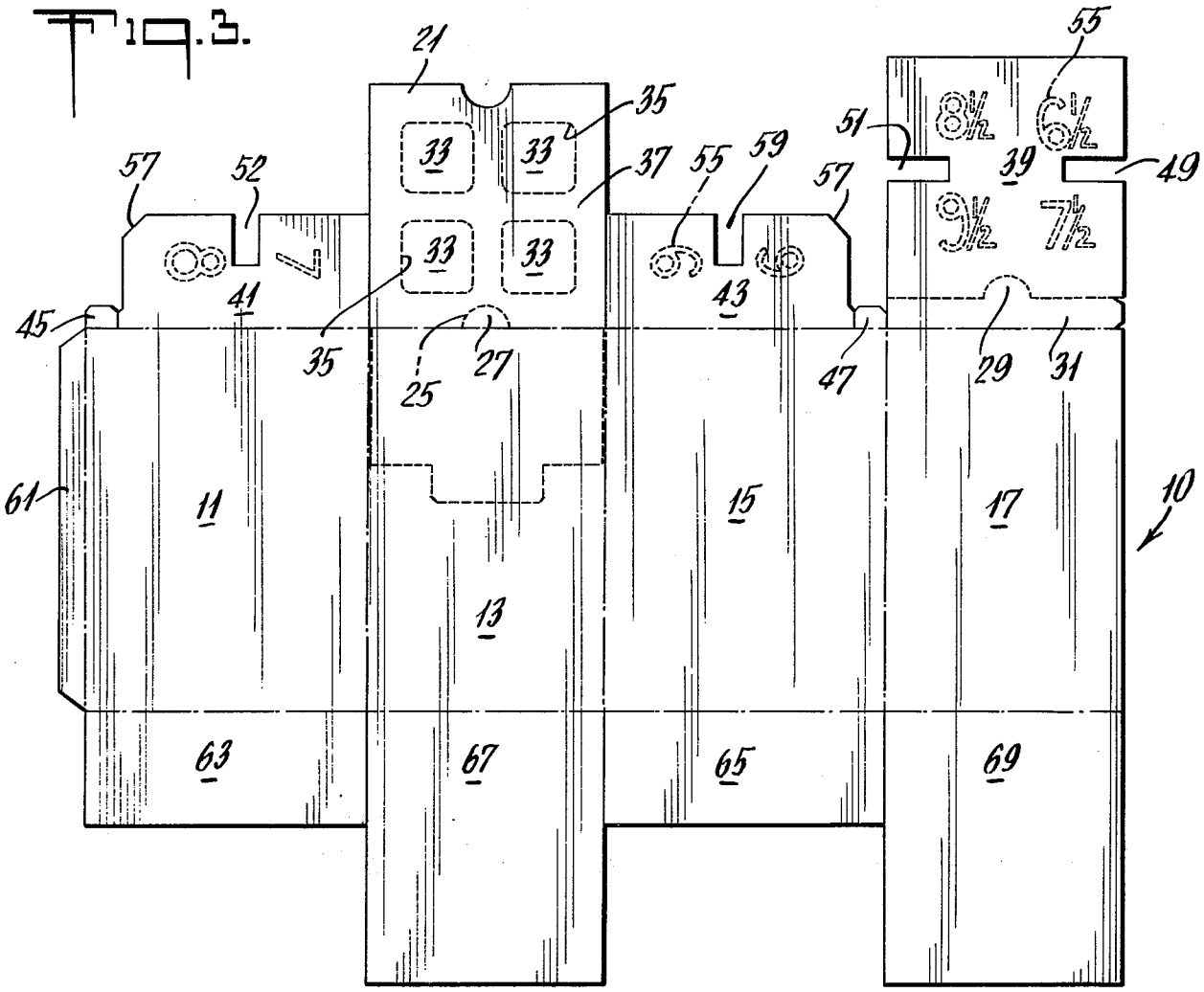

The construction features of the identification wall 21 are shown in detail in FIG. 2. This wall 21 includes an outer major panel 37 used to mask the identification symbols, an inner major panel 39 containing the previously discussed access flap 31, a pair of dust flaps 41, 43 and a pair of dust tabs 45, 47.

The masking outer panel 37 is formed as a rectangular extension of the top side wall 13 of the box 10. This masking panel 37 is folded over to extend downwardly 6½ inches or as far as the location of the access flap 31 perforation line 29, with the free end of this masking panel 37 describing the shape thereof and lying upon this perforation line 29 when the identification wall 21 is fully assembled. Contained in this masking panel 37 are the four essentially rectangular, display windows 33 defined by their respective tear tab perforations 35. One of these tabs can be removed to display one of the four possible symbols behind the panel 37. A cut-out section 38, about the size of the semicircular excursion of the perforation line 29 is located at midpoint on the outer free edge of this, making outer panel 37.

The inner major panel 39 is formed as a rectangular extension of the bottom side wall 17 of the box 10. This inner panel is folded over to extend upwardly 7 inches to the top side wall 13 fold line. The access flap 31 perforation line 29 transgresses this panel about 1 inch up from the bottom side wall 17 fold line. This perforation line 29, as described above, defines the access flap 31, also described above in the discussion of the inner panel 39.

The inner panel 39 also has two cut-out sections 49 and 51 along its outer edges. These two cut-outs 49, 51 are rectangularly shaped and extend each from the opposing side edges of the panel 39, at points approximately half way between the perforation line 29 and the outer free edge of the panel 39 towards one another, a distance of about 1.75 inches. These rectangular cut-outs 49, 51 are approximately 0.5 inches wide.

Identification symbols 55 may be painted, printed or otherwise attached to the outer surface of the inner major panel 39 at respective locations in each quadrant of this panel 39 area above the access opening fold line 29 so as to be available one each under the four possible viewing windows 33 when the outer major panel 37 is folded over the major inner panel 39.

The dust flaps 41, 43 are each identically-shaped mirrored-images of one another. Each flap 41, 43 is formed as approximately a 6½ inch wide rectangular extension of its respective side walls 11, 15 which protrude approximately 3¼ inches from the side walls 15, 17 fold line at a location beginning with the top side wall 13 end of the fold line and ending approximately 1 inch from the bottom side wall 17. A triangular cut-out 57, to clear the thumb hole window 38 in the major outer panel 37, truncates each free outer corner of the dust tabs 41, 43.

A rectangular cut-out 59 approximately 6/10 inches wide extends inwardly from the free edge opposite the fold line of each dust flap 41, 43, for a distance of approximately 1.5 inches.

Identification symbols 55 may be painted, printed or otherwise attached to the outer surface of each dust flap 41, 43. These symbols 55 are located at locations which make them available one each under the four possible viewing windows 33 when the outer major panel 37 is folded over the dust flaps 41, 43.

The pair of dust tabs 45, 47 are identically shaped to extend as rectangular protrusions from their respective side walls 11, 15 at a location between the edge of the respective dust flap 41, 43 and the bottom side wall 17 fold line. Each dust tab 45, 47 is approximately 1 inch wide and extends approximately 6/10 inches out from its respective side wall 11, 15.

The blank from which the folded box 10 may be constructed is shown in FIG. 3. This one piece blank which is folded upon itself to form the box 10 has four main rectangular panels 11, 13, 15, 17, joined at their long sides, which form the right side wall 11, top side wall 13, left side wall 15 and bottom side wall 17, respectively, of the assembled box. Extending from the free long side of the right side wall 11, and running along its entire length is the glue tab 61.

Short rectangular panels 63, 65, about one-third as long as they are wide, each extend outwardly from the same end of the side walls 11, 15 respectively, and along these sides 11, 15, entire widths.

Long rectangular panels 67, 69, each extend outwardly along the entire width, from like ends of the top and bottom side walls 13, 17, respectively, a distance equal to the width of the top and bottom side walls 13, 17.

Extending from the end of the right side wall panel 11, opposite the end connected to the short rectangular panel 63, are the dust flap 41 and dust tab 45 described above. The dust flap 41 extends from the jointure of the right side wall panel 11 to the top side wall panel 13, to a point near the outside edge of the panel 11 where the dust tab 45 begins and continues to the outer edge of this panel 11.

Extending from remaining free edge of the top side wall panel 13 along its entire width is the masking panel 37 described above.

Extending from the remaining free edge of the left side wall panel 15 are the dust flap 43 and the dust tab 47. The dust flap 43 extends from the edge of this panel 15 adjacent the masking panel 37 to a point near the other edge where the dust tab 47 begins and continues to the edge of this panel 15. Greater detail concerning this dust flap 43 and dust tab 47 have been discussed above.

The inner major panel 39, described above, extends from the remaining free edge of the bottom side wall panel 17 along its entire width.

With the blank folded upon itself to create a bend at the joining edge of each panel and tab, the box 10 may be assembled. During this process, the major side panels 11, 13, 15, 17 are folded to form a rectangular shape with the glue tab 61 folded and glued to the inside of the mating free edge of the right side wall panel 11.

The short rectangular end panels 63 and 65 are folded inwardly with the long rectangular panels 67, 69 folded thereupon, respectively. These four panels 63, 65, 67, 69 are glued together to form the bottom closure 19 of the box 10.

The dust tabs 45, 47, dust flaps 41, 43, major inner panel 39 and major outer panel 37 are all folded inwardly upon one another and glued in place to form the identification end 21 of the box 10. The sequence by which the dust flaps 41, 43 and the inner major panel 39 are folded upon one another determines which of the possible symbols residing thereon are available for viewing through the major outer, i.e., masking panel 37. To display a symbol printed on one of the dust flaps 41, 43, these are folded over the inner major panel 39. To display a symbol printed on the inner major panel 39 this panel is folded over the dust flaps 41, 43.

The rectangular cut-outs 59 in the dust flaps 41, 43 and the rectangular cut-outs 49, 51, facilitate the flow of glue when these flaps are glued together.

Figure 4:
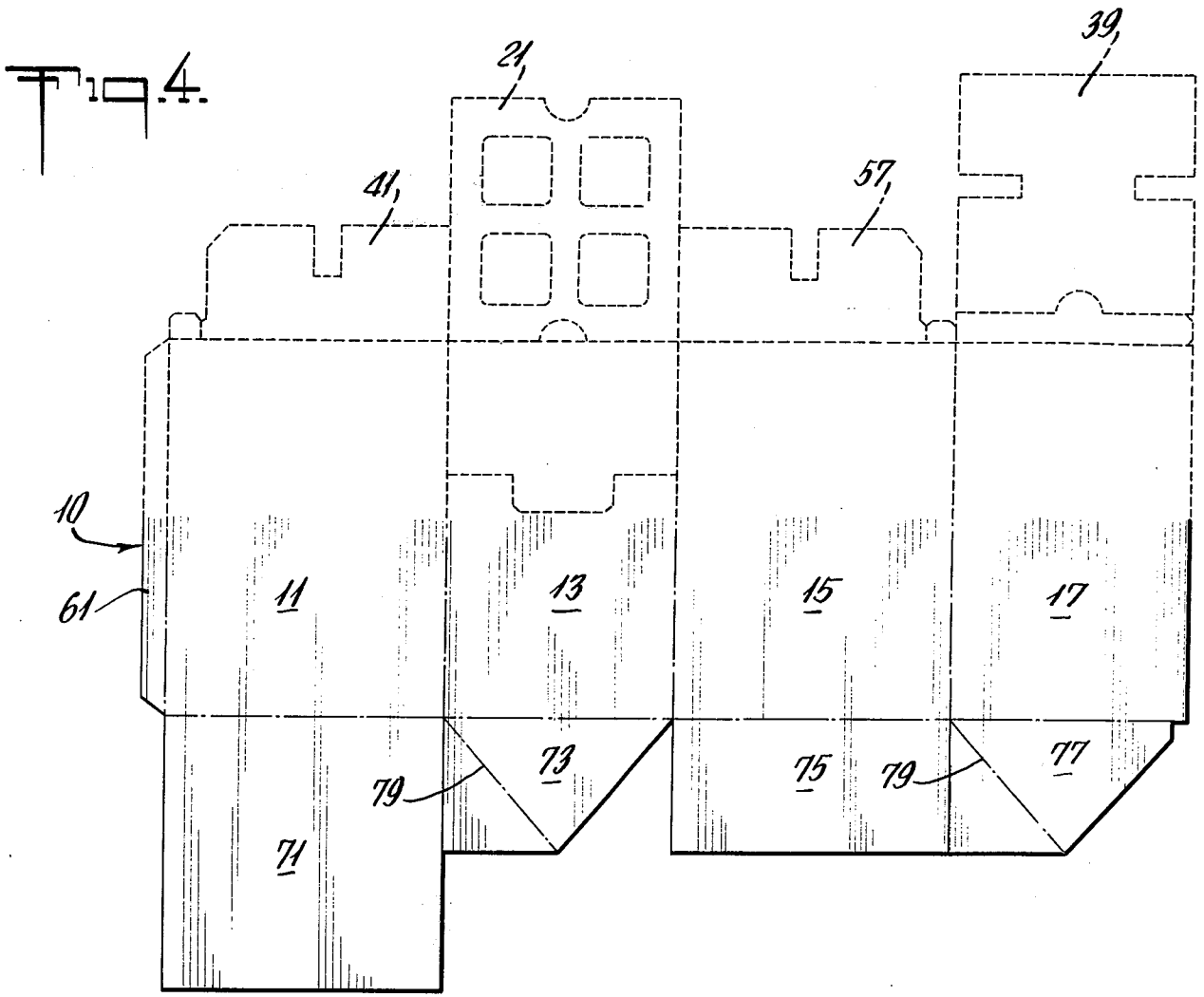
FIG. 4 shows the blank utilizing an "auto-lock bottom" on the side opposite the identification end.

FIG. 4 shows the blank from which the alternate embodiment, box 20, may be constructed. This blank 20 is identical to the blank 10 shown in FIG. 3 with the exception that the glue end panels 63, 65, 67, 69 of FIG. 3 are replaced with "auto-lock" end panels 71, 73, 75, 77. As seen in FIG. 4, a large rectangular end panel 71 extends outwardly from the end of the right side wall 11 opposite the dust flap 41 while a shorter, about one-half as long as the panel 71, and rectangular end panel 75 extends from the similar end of side wall 15, both panels 71, 75 extending from the entire length of their respective sides 11, and 15.

Extending from the like end of the top side 13 is a first "auto-lock" fold panel 73. This first fold panel 73 is cut from a rectangular section similar in size to the shorter end panel 75. The outer free corner of this panel 73, adjacent the end panel 75, is truncated, running from the midpoint of its outer free edge to the top side 13 fold line. A score line 79 extends from the outer free edge midpoint to the top side fold line at the end panel 71.

A second "auto-lock" fold panel 77 extends from the bottom side 17. This second panel 77 is cut from an identical size section with an identical triangular truncation and score line 79 as the first fold panel 73. This second panel differs only that an additional trapezoidal section is removed from the triangularly truncated side of the panel 77.

Since many changes could be made in the above-described apparatus and method of operation and many different embodiments of this invention could be made without departing from the scope thereof, it is intended that matter contained herein be taken as illustrative and not in the limiting sense.

What is claimed:

1. A box with interchangeable identification including a rectangular enclosure having four walls, a bottom closure at one end of said rectangular enclosure and an identification closure at the other end thereof, said identification closure comprising:

first means for making available for display, exclusively, a first plurality of symbols, this plurality being a portion of the total symbols available, said means being attached to two said opposing walls of said rectangular enclosure;

second means for making available for display, exclusively, a second plurality of symbols, this plurality being the remaining portion of the total symbols available, said means being attached to a wall of said rectangular enclosure adjacent to said first means attachment; and means connected to said remaining of said rectangular closure walls for selectively displaying one of said symbols made available.

2. The box of claim 1 wherein said identification closure also includes means for accessing the interior of the box, said interior accessing means being associated with second symbol display making means.

3. The box of claim 2 wherein said first symbol display making means includes:

a pair of dust flaps, said flaps each extending from an opposing wall of said rectangular enclosure and being foldable inwardly towards one another to completely extend behind said selective display means; and a first plurality of symbols, said symbols being located on the outer side of both flaps and each representing one, exclusively, of the possible contents for the box.

4. The box of claim 3 wherein said second symbol display making means includes:

an inner major panel, said panel extending from a wall of said rectangular enclosure adjacent to said walls of said dust flaps attachment, said inner major panel being foldable inwardly to completely extend behind said selective display means; and a second plurality of symbols, this second plurality being the remaining portion of the total symbols available, each representing one, exclusively, of the possible contents for the box.

5. The box of claim 4 wherein said selective display means includes:

an outer major panel, said panel extending from the remaining of said rectangular closure walls and being foldable inwardly to overlap said pair of dust flaps and said inner major panel; and a plurality of tear tab display windows through said outer major panel and located inboard away from the edges of said outer major panel, said tear tabs being selectively removable to display a symbol made available behind said outer major panel.

6. The box of claim 5:

wherein said inner major panel includes an access flap, said access flap being separable from said inner panel via a perforation line;

wherein said outer major panel includes a thumb hole to facilitate produce removal;

wherein said outer major panel does not extend into said inner panel access flap area; and wherein said pair of dust flaps do not extend into said inner panel access flap area nor into said outer panel inspection window area.

7. A one piece blank comprising:

four rectangular main panels connected to one another along the entire length of their longer edges;

first and second smaller rectangular end panels extending one each from the same end of two non-adjacent of said four main panels along their entire width;

first and second larger rectangular end panels extending one each from the other two non-adjacent of said four main panels along their entire width at their end adjacent to said small extending rectangular end panels;

a glue tab extending the entire free length of one of said four main panels;

a first and second end tab extending one each from opposite edges of the same end of the two main panels opposite the small rectangular end panels, said first and second end tabs being smaller rectangular sections and extending along only part of the width of said main panels;

a first and second end flap extending one each from opposite edges of the two main panels as said first and second end tabs said first and second end flaps being adjacent to said first and second end tabs, respectively, and extending for the remaining width of said respective main panel, said end flaps each having their outer corners truncated and having a rectangular cut-out in their outer end;

an inner major end panel extending from said remaining panel free end adjacent to an end tab and extending for the entire width, said panel having a pair of opposing rectangular cut-outs extending inwardly from its opposing free edge and a semicircular cut-out in its outer free edge; and an outer major end panel extending from said remaining main panel free end adjacent to an end flap and extending for the entire width of the panel, said panel having four tear-tab windows located inboard from outer edges thereof and extending therethrough and having a semicircular cut-out in its outer free edge.

* * * * *